US010621863B2

(12) United States Patent
Gaither

(10) Patent No.: US 10,621,863 B2
(45) Date of Patent: Apr. 14, 2020

(54) TRAFFIC SIGNAL LEARNING AND OPTIMIZATION

(71) Applicant: TOYOTA MOTOR ENGINEERING & MANUFACTURING NORTH AMERICA, INC., Plano, TX (US)

(72) Inventor: Geoffrey D. Gaither, Brighton, MI (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 0 days.

(21) Appl. No.: 16/222,908

(22) Filed: Dec. 17, 2018

(65) Prior Publication Data

US 2019/0122547 A1 Apr. 25, 2019

Related U.S. Application Data

(63) Continuation of application No. 15/698,602, filed on Sep. 7, 2017, now Pat. No. 10,192,434.

(51) Int. Cl.
*G08G 1/07* (2006.01)
*G08G 1/095* (2006.01)
(Continued)

(52) U.S. Cl.
CPC ..... *G08G 1/07* (2013.01); *G08G 1/0112* (2013.01); *G08G 1/0116* (2013.01);
(Continued)

(58) Field of Classification Search
CPC ..... G08G 1/07; G08G 1/0112; G08G 1/0116; G08G 1/0129; G08G 1/0133;
(Continued)

(56) References Cited

U.S. PATENT DOCUMENTS 4,573,049 A 2/1986 Obeck
4,775,865 A 10/1988 Smith
(Continued)

OTHER PUBLICATIONS

Booz Allen Hamilton, AERIS—Applications for the Environment: Real-Time Information Synthesis program. Eco-Signal Operations Modeling Report, U.S. Departmnt of Transportation, www.its.dot.gov/index.htm, Dec. 2014, 268 pages.
(Continued)

*Primary Examiner* — Hung T Nguyen
(74) *Attorney, Agent, or Firm* — Sheppard, Mullin, Richter & Hampton LLP; Hector A. Agdeppa; Daniel N. Yannuzzi

(57) ABSTRACT

Systems and methods are provided for altering the default operation of traffic signals, e.g., static cycling of lights, based on one or more road conditions and/or operating characteristics of vehicles at or near an intersection at which the traffic signals are located. The timing of light changes in traffic signals can be altered based upon a desire to optimize fuel efficiency, prioritize passage of vehicles through the intersection, and/or exhibit favoritism to vehicles that are driven efficiently and/or by drivers contributing to a pay-to-pass system. Traffic signal controllers controlling traffic signals may, over time, learn traffic patterns based on gathered information regarding the operating characteristics of vehicles and/or road conditions.

15 Claims, 8 Drawing Sheets

(51) Int. Cl.
*G08G 1/08* (2006.01)
*G08G 1/01* (2006.01)
*G08G 1/081* (2006.01)

(52) U.S. Cl.
CPC ..... *G08G 1/0129* (2013.01); *G08G 1/0133* (2013.01); *G08G 1/0145* (2013.01); *G08G 1/08* (2013.01); *G08G 1/081* (2013.01); *G08G 1/095* (2013.01)

(58) Field of Classification Search
CPC ..... G08G 1/0145; G08G 1/08; G08G 1/095; G08G 1/048; G08G 1/082; G08G 1/087
USPC ..... 340/907, 909, 910, 916, 917, 933
See application file for complete search history.

(56) References Cited

U.S. PATENT DOCUMENTS 7,248,149 B2 7/2007 Bachelder
7,432,826 B2 * 10/2008 Schwartz ..... G08G 1/081 340/902
9,805,595 B1 * 10/2017 Liebinger Portela ..... G08G 1/0145
10,002,530 B1 * 6/2018 Liu ..... G08G 1/005
2004/0145497 A1 * 7/2004 Pearson ..... G08G 1/07 340/906
2015/0066350 A1 3/2015 Iwata
2017/0234696 A1 8/2017 Boesch
2018/0063261 A1 * 3/2018 Moghe ..... H04L 67/18

OTHER PUBLICATIONS

Julio A. Sanguesa et al, Sensing Traffic Density Combining V2V and V2I Wireless Communications, Sensors, dated Aug. 27, 2015, 17 pages.

Matthew Barth et al; Intelligent Transportation Systems for Improving Traffic Energy Efficiency and Reducing Emissions GHG from Roadways, National Center for Sustainable Transportation, dated Nov. 2015, 19 pages.

* cited by examiner

TRAFFIC SIGNAL LEARNING AND OPTIMIZATION

CROSS-REFERENCE TO RELATED APPLICATIONS

The present application is a continuation of and claims priority to U.S. patent application Ser. No. 15/698,602, filed Sep. 7, 2017, now U.S. Pat. No. 10,192,434, which is incorporated herein by reference in its entirety.

TECHNICAL FIELD

The present disclosure relates generally to altering or adjusting the operation of traffic signals. In particular, some embodiments are directed to obtaining operating characteristics of one or more vehicles proximate to a traffic intersection having one or more traffic signals. Based on those operating characteristics, the default operation of the traffic signals may be altered to achieve greater fuel economy/efficiency. Moreover, in some embodiments, the operating characteristics may be used to train the traffic signals.

DESCRIPTION OF RELATED ART

Control of some conventional traffic signals may be based on cycling through illumination of a traffic signal's red, yellow, and green lights. Based on, e.g., the time of day, illumination times of the different lights may vary. Some conventional traffic signals may also be controlled through sensors embedded in the road that determine the presence of vehicles. In this way, allocating "green time," for example, can be optimized based on existing traffic conditions. In general, traffic signals are configured to promote smooth traffic flow. Recently, there has been a desire to control the operation of traffic signals in a more dynamic fashion.

BRIEF SUMMARY OF THE DISCLOSURE

In accordance with one embodiment, a method may comprise determining whether one or more vehicles is proximate to one or more intersections having one or more traffic signals. The method may further comprise receiving information regarding at least one of road conditions and operating characteristics of at least a first vehicle of the one or more vehicles. Additionally, the feasibility of altering a default operation of at least one of the one or more traffic signals based upon the received information may be determined. Further still, whether a fuel efficiency aspect of the operating characteristics of the at least first vehicle warrants the alteration of the default operation of the at least one of the one or more traffic signals can also be determined. Accordingly, the default operation of the at least one of the one or more traffic signals upon a determination that the alteration is warranted can be altered.

In some embodiments, determining the feasibility of altering the default operation of the at least one of the one or more traffic signals comprises determining whether the at least one of the one or more traffic signals is due for a light change while the at least first vehicle is approaching at least one of the one or more intersections. In some embodiments, determining the feasibility of altering the default operation of the at least one of the one or more traffic signals further comprises determining whether a second vehicle of the one or more vehicles is approaching the at least one of the one or more intersections from a direction different from that of the first vehicle. In some embodiments, determining the feasibility of altering the default operation of the at least one of the one or more traffic signals further comprises determining whether the at least first vehicle is located within a safe approach timing zone relative to the at least one of the one or more intersections.

The method may further comprise maintaining a default operation mode of the at least one of the one or more traffic signals upon a determination that the at least first vehicle is not located with the safe approach timing zone. In some embodiments, determining the feasibility of altering the default operation of the at least one of the one or more traffic signals further comprises comparing fuel efficiency of the first vehicle to fuel efficiency of the second vehicle. In some embodiments, the alteration to the default operation of the at least one of the one or more traffic signals comprises delaying the light change until the first vehicle passes the at least one of the one or more intersections. This can be done upon a determination that the first vehicle is less fuel efficient than the second vehicle.

In some embodiments, the alteration to the default operation of the at least one of the one or more traffic signals comprises delaying the light change until the first vehicle passes the at least one of the one or more intersections. This can be done upon a determination that the first vehicle is more fuel efficient than the second vehicle.

In some embodiments, the alteration to the default operation of the at least one of the one or more traffic signals comprises delaying the light change until the first vehicle passes the at least one of the one or more intersections. This can be done upon a determination that the first vehicle is being driven in a more fuel efficient manner than the second vehicle.

In some embodiments, the alteration to the default operation of the at least one of the one or more traffic signals comprises delaying the light change until the first vehicle passes the at least one of the one or more intersections. This can be done upon a determination that the first vehicle is associated with a payment into a pay-to-pass system greater than that associated with the second vehicle.

In some embodiments, the method may further comprise weighting the fuel efficiency of at least one of the first and second vehicles based upon one or more factors. Those factors can be factors impacting at least one of current fuel economy, historical fuel economy, operating characteristics-dependent fuel economy, and trip-wide fuel economy.

In some embodiments, the method may further comprise at least one of storing the received information and updating previously stored information with the received information. This information may be stored along with at least one of the feasibility determination and information representative of the alteration to the default operation of the at least one of the one or more traffic signals.

In some embodiments, the method may further comprise revising the default operation of the at least one of the one or more traffic signals based on the at least one of the stored, received information and the updated, stored information.

In accordance with one embodiment, a system may comprise at least one processor, and at least one memory unit operatively connected to the processor, the at least one memory unit having stored thereon, at least one computer program comprising computer code. The computer code may cause the at least one processor to determine whether at least one traffic signal in an intersection will experience a light change while a first vehicle is approaching the intersection traveling in a first direction. The computer code may cause the at least one processor to determine whether a second vehicle is approaching the intersection traveling in a second direction. The computer code may cause the at least one processor to obtain at least one of current road conditions and operating characteristics of at least one of the first and second vehicles. The computer code may cause the at least one processor to determine whether a distance of the first vehicle from the intersection is within a safety threshold. The computer code may cause the at least one processor to alter timing of the light change to allow passage of the first vehicle through the intersection. This can be done upon a determination that the distance of the first vehicle from the intersection is within the safety threshold and the at least one of the current road conditions and the operating characteristics of the first vehicle result in travel priority over the second vehicle.

In some embodiments, at least one of the first and second vehicles communicate their respective operating characteristics to one or more roadside units via one or more dedicated short-range communications channels of an intelligent transportation system. The at least one processor and the least one memory receive at least one of the current road conditions and the operating characteristics from the one or more roadside units. The system may further comprise one or more sensors implemented as part of roadway infrastructure adapted to obtain identifying information from at least one of the first and second vehicles. The identifying information may be transmitted to an information resource to determine a fuel efficiency aspect of the operating characteristics of the at least one of the first and second vehicles.

In some embodiments, the travel priority is based upon at least one of fuel economy and an amount of contribution to a pay-to-pass system. In some embodiments, the system may further comprise a timing database operatively connected to the at least one traffic signal controller. The at least one traffic signal controller accesses timing data stored in the timing database to determine timing of subsequent light changes of the at least one traffic signal. In some embodiments, the timing data is derived from the at least one of the current road conditions and the operating characteristics of at least one of the first and second vehicles.

In some embodiments, the computer code further causes the at least one processor to predict additional alterations to the timing of subsequent light changes. These can be based upon a pattern of traffic at or proximate to the intersection observed via the at least one of the current road conditions and the operating characteristics of the at least one of the first and second vehicles.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

Figure 1:
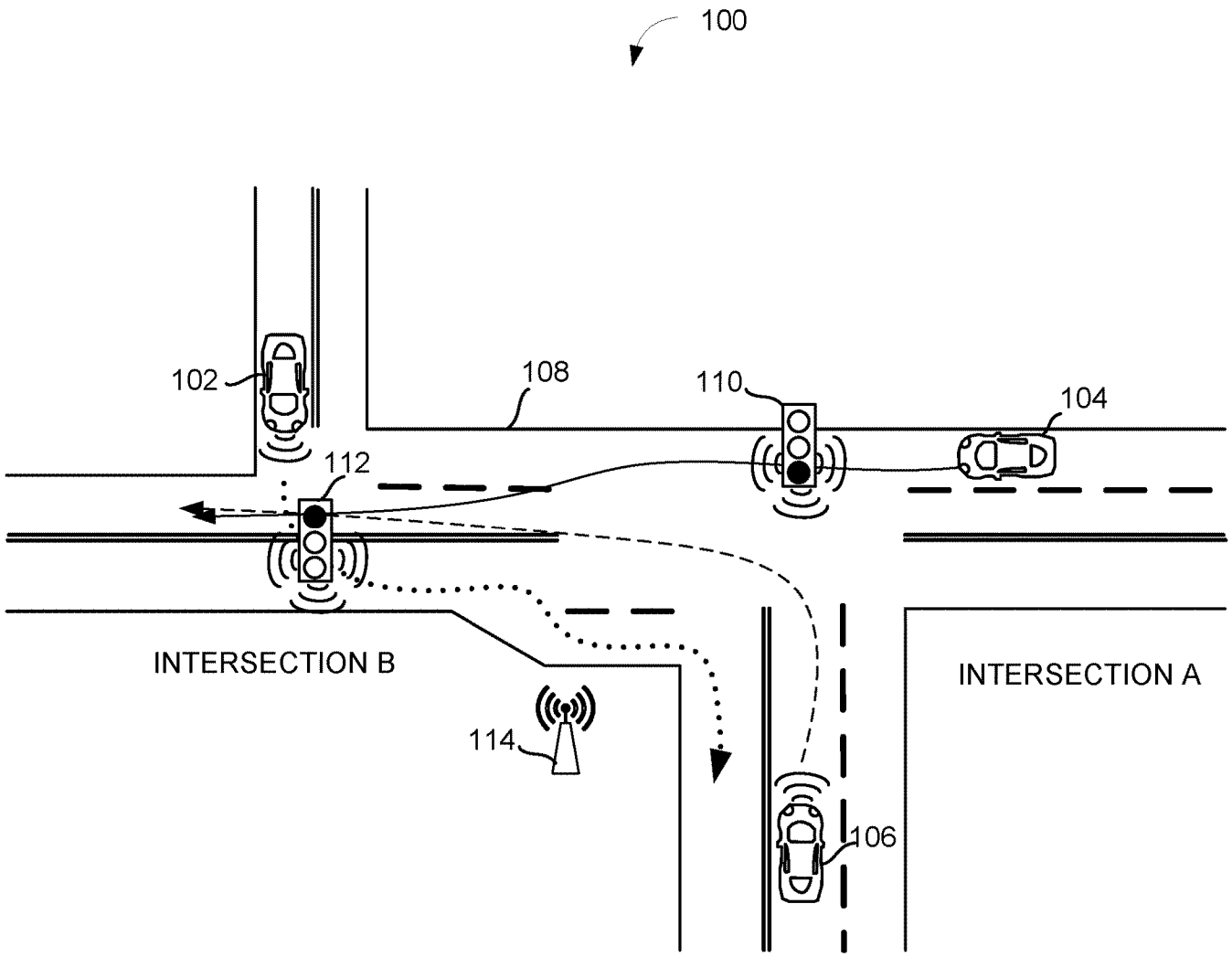
FIG. 1 is a graphical illustration or an example traffic scenario for which dynamic traffic control in accordance with various embodiments may be used.

The figures are not exhaustive and do not limit the present disclosure to the precise form disclosed.

DETAILED DESCRIPTION

Various embodiments are directed to systems and methods of dynamic traffic signal control that can be used to optimize fuel economy and traffic efficiency (for individual drivers and their vehicles, as well as collectively, e.g., for groups of drivers/vehicles). Information regarding one or more vehicles' operating, road, and/or traffic conditions can be communicated from a vehicle's sensor(s)/electronic control unit or roadside units to a traffic signal controller that controls the timing of one or more traffic signal lights. The traffic signal controller can adjust a default timing of the one or more traffic signals lights to accommodate or account for the vehicles' operating, road, and/or traffic conditions in a way that optimizes fuel economy and traffic efficiency. That is, the respective fuel economy "rankings" of each vehicle approaching or stopped at a traffic signal can be compared. The changing of traffic signal lights can be dynamically altered to, e.g., favor the vehicle with the best fuel economy so that the vehicle can maintain its current fuel economy. The changing of traffic signal lights can be dynamically altered to, e.g., favor the vehicle with the worst fuel economy so as to avoid further lowering its already poor fuel economy with frequent stops. The changing of traffic signal lights can be dynamically altered to, e.g., show favoritism to those vehicles that contribute monetarily to a pay-to-pass system that can be used to pay for infrastructure improvements, for example, or that are driven in a fuel efficient manner. Moreover, traffic patterns can be learned by the traffic signal controller obtaining and storing the received vehicle operating, road, and/or traffic conditions. The traffic patterns can be used to better optimize traffic signal operation to again, optimize fuel or traffic efficiency.

For example, a determination can be made to ascertain whether one or more vehicles are proximate to one or more intersections having one or more traffic signals. Information about operating characteristics of vehicles proximate to such intersections, as well as road conditions can be obtained. In some embodiments, vehicle-to-infrastructure (V2I) communications can be leveraged to obtain such information. Moreover, in some embodiments, vehicle-to-vehicle (V2V) communications can be used to exchange information regarding vehicle operating characteristics. This may promote better fuel efficiency in contexts where the, e.g., the fuel economy associated with groups of vehicles is used as a basis for altering traffic signal operation. It should be noted that the terms fuel economy and fuel efficiency may be used interchangeably. In some embodiments, the fuel efficiency of a vehicle may be referred to/characterized in terms of a fuel economy rating or value.

Based on this information, the feasibility of altering a default operation of the one or more traffic signals can be determined. The feasibility determination may include determining whether or not changing a light of a traffic signal would impact the safety of an approaching vehicle. If it would be feasible to alter operation of the one or more traffic signals, the fuel economy of a proximate vehicle(s) can be determined. Based on this determination, operation of the one or more traffic signals may be altered. For example, changing between lights, e.g., changing from a green light to a yellow light, may be delayed to accommodate one or more vehicles based on their fuel economy.

In some embodiments, altering the operation of traffic signals can be done to promote fuel economy optimization. In some embodiments, altering the operation of traffic signals can be done to provide traffic priority to vehicles with better fuel economy. Further still, favoritism can be shown to vehicles whose drivers have paid money to support roadway infrastructure improvements, for example, as well as to reward drivers that operate their vehicles in a fuel efficient manner. In some embodiments, the system(s) controlling operation of traffic signals can be configured to collect information so that the system(s) can learn traffic patterns, vehicle characteristics, etc. in order to effectuate the above-mentioned features.

It should be noted that the terms "optimize," "optimal" and the like as used herein can be used to mean making or achieving performance as effective or perfect as possible. However, as one of ordinary skill in the art reading this document will recognize, perfection cannot always be achieved. Accordingly, these terms can also encompass making or achieving performance as good or effective as possible or practical under the given circumstances, or making or achieving performance better than that which can be achieved with other settings or parameters.

FIG. 1 illustrates an example scenario in which traffic signal operation may be altered from a default or conventional method of operation, and in which a traffic signal system may learn in accordance with various embodiments. In the illustrated example, one or more vehicles, e.g., vehicles 102, 104, and 106, are operating on road 108. Vehicles 102, 104, and 106 may be stopped at an intersection and/or may be approaching an intersection at which one or more traffic signals, e.g., traffic signals 110 and 112, may be operating. It should be understood that various embodiments are directed to altering traffic signal operation. That is, various embodiments may be implemented to optimize traffic signal operation as described herein, where traffic signals may have already been configured to operate in accordance with "standard" or conventional control systems and methods, such as static cycling of lights.

In the example of FIG. 1, vehicle 102 may be an internal combustion engine (ICE)-only vehicle, such as a pickup truck. Vehicle 102 may be determined to be 4.9 seconds or some distance from intersection A. Vehicle 102 may be determined to be stopped at intersection B, e.g., 0.0 seconds or 0 m from intersection B. Such information may be operating characteristics information obtained based on, e.g., navigation-based calculations, and transmitted by vehicle 102 to traffic signals 110, 112 and/or roadside unit 114 via V2I communications. Alternatively, such operating characteristics may be determined by one or more sensors implemented in/near traffic signals 110, 112 and/or roadside unit 114, or implemented under the roadway (not shown). Vehicle 102 may have one or more internal sensors or systems that can determine its current fuel economy, which in this scenario may be 15 mpg for a non-stop condition. From another perspective, vehicle 102 may be considered to have a relative fuel economy difference/benefit from not stopping or idling for a period of time of, e.g., +3.5 mpg. As one might appreciate, the fuel economy of an ICE-only pickup truck is likely to be poor compared to smaller vehicles, hybrid or electric-only vehicles, etc. Moreover, an "eco-driving score" can be assigned to vehicle 102 that is representative of a driver's driving habits in the context of fuel economy (described below). In this example scenario, the eco-driving score associated with vehicle 102 may be, e.g., 43 out of a possible 100. It should be understood that the eco-driving score can be determined and/or represented in a variety of ways, e.g., as the aforementioned numerical score, as a lettered grade representative of a range, etc. The eco-driving score may be determined by analyzing a recent period and/or historical period of driving relative to speed, acceleration, and stopping events experienced by vehicle 102.

Vehicle 104 in the example scenario illustrated in FIG. 1 may be an ICE-only sedan. It may be determined to be 1.1 seconds from intersection A and 6.8 seconds from intersection B. Vehicle 104 may have a current fuel economy of 30 mpg when in motion at a current speed and/or rate of acceleration (i.e., non-stop condition), or a relative fuel economy difference/benefit of +1.0 mpg. Based on the driving habits or characteristics of the driver of vehicle 104, vehicle 104 may have an eco-driving score of, e.g., 69 out of 100. The operating characteristics may be determined in the same or similar manner as that described above for vehicle 102.

Vehicle 106 may be a hybrid electric vehicle powered by an electric motor and an ICE. Vehicle 106 may be determined to be 2.1 seconds from intersection A, 7.9 seconds from intersection B, and have a current fuel economy of 55 mpg when moving at a current speed/acceleration, or a fuel economy difference/benefit of, e.g., +1.5 mpg. Vehicle 106 may have an eco-driving score of 93 out of 100. The operating characteristics may be determined in the same or similar manner as that described above for vehicle 102.

Figure 2:
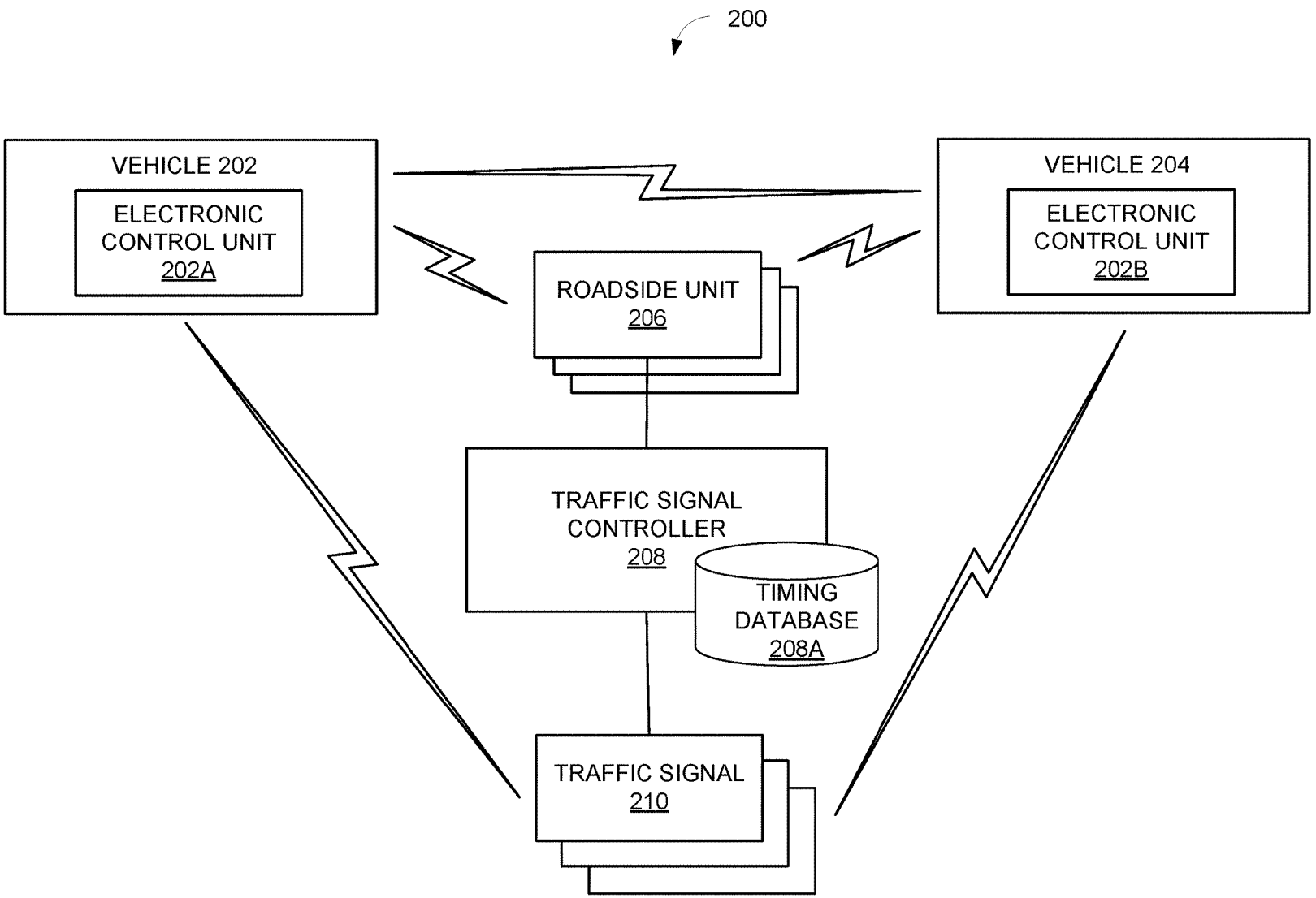
FIG. 2 is a schematic representation of an example dynamic traffic control system architecture.

FIG. 2 illustrates an example architecture of a dynamic traffic control and learning system 200 in accordance with various embodiments. System 200 may communicate with one or more vehicles directly or through an intermediate system element, such as a traffic signal or roadside unit. In this example, vehicles 202 and 204 may communicate with one or more roadside units 206. For example, vehicles 202 and 204 may transmit their respective operating characteristics to one or more roadside units 206. Alternatively, vehicles 202 and 204 may transmit their respective operating characteristics to one or more traffic signals 210. It should be understood that vehicles 202 and 204 may transmit their respective operating characteristics via different communications mechanisms. For example, vehicle 202 may transmit one or more of its operating characteristics to one of roadside units 206, while vehicle 204 may transmit one or more of its operating characteristics to one or more of traffic signals 210. In some embodiments, operating characteristics of vehicles 202 and 204 may be sent to more than one element of system 200. This may be done, for example, to provide redundancy and/or to provide multiple sources of information that can be compared or used as a way to verify the validity of received information, as well as increase accuracy of the information. For example, an embedded roadway sensor may not be operating correctly, and may incorrectly determine a vehicle's proximity to an intersection. This misinformation can be mitigated if, e.g., a vehicle provides its own proximity (distance calculations) and one or more other sensors or roadway infrastructure provide their respective proximity determinations.

It should be further understood that each of vehicles 202 and 204 may have electronic control units (ECUs) 202A and 204A that control one or more operating aspects of their respective vehicles. For ease of explanation, it is assumed that relevant operating characteristics can be determined by each vehicles' ECUs, and transmitted to one or more elements of system 200. However, operating characteristics may be determined by separate sensors or systems in a vehicle and transmitted separately. It may also be assumed that each of vehicles 202 and 204 have respective datastores (not shown) for maintaining fuel economy logs, recent or historical driving characteristics/events, and the like.

Each of vehicles 202 and 204 may also have communication units (not shown), e.g., wireless/radio frequency-based communications units for communicating with system 200 and/or each other. In some embodiments, one or more of vehicles 202 and 204 may not have V2I or V2V communications capabilities (described below). Communications may be short-range, medium-range, and/or long-range-based communications, and may involve communications over one or more networks, such as Bluetooth, Wi-Fi, cellular, vehicular, and other networks. In some embodiments, communications between vehicles or with road infrastructure, such as roadside units 206, can be effectuated using, at least in part, on board units configured to communicate over dedicated short-range communications channels. An example of dedicated short-range communications channels are channels in the 5.9 GHz band allocated for use by intelligent transportation systems.

Roadside units 206 may be various types of communications nodes in a vehicular communication network, such as a V2I communications network. In some embodiments, roadside units 206 may be configured to operate as, e.g., dedicated short-range communications devices. In some embodiments, roadside units 206 may communicate with one another, with one or more vehicles, such as vehicles 202 and/or 204, as well as with one or more other entities. Those entities may be information providers that disseminate, e.g., traffic-related information, that roadside units 206 may forward to vehicles and/or retain as information, e.g., road conditions, to be used in various embodiments for learning and adjusting traffic signal operation.

Traffic signal controller 208 may be a localized controller implemented in a particular location having a certain radius or area of operation. For example, and referring back to FIG. 1, traffic signal controller 208 may be a traffic signal controller configured to control traffic signals 110 and 112 at intersections A and B. Accordingly, a traffic grid controlled by a municipality, city, state, or other entity may have a network of distributed traffic signal controllers. In another embodiment, traffic signal controller 208 may be a centralized controller configured to control all traffic signals within, e.g., a city, municipality, state, or other entity. One or more timing databases 208A may be used to store traffic signal illumination timing cycles, sequences, or other timing-related data. In some embodiments, one or more timing databases 208A may be used to store road conditions and/or vehicle operating characteristics for learning purposes as well as traffic signal alterations.

In some embodiments, traffic signals 210 may be conventional traffic signals that are operatively connected to traffic signal controller 208. Traffic signals 210 may be configured to operate in accordance with a conventional or default cycling scheme or algorithm that can be adjusted based on road conditions and/or vehicle operating characteristics are described herein.

In still other embodiments, a separate traffic signal controller may not be needed. That is, traffic signals 210 may each have controllers implemented therein to control their operation. In other embodiments, one of a local plurality of traffic signals may be configured with a controller for controlling its own operation as well as some number of other traffic signals. Referring back to FIG. 1, for example, traffic signal 110 may be configured with a controller that controls its own operation as well as that of traffic signal 112.

Based on the road conditions and/or vehicle operating characteristics information, traffic patterns can be learned by traffic signal controller 208 and used to adjust the timing, e.g., cycling of lights of traffic signals 210. Moreover, the road conditions and/or vehicle operating characteristics information can be used by traffic signal controller 208 to, on-the-fly, alter the default operation of traffic signals 210 to account for, e.g., fuel economy optimization, prioritization, and/or favoritism.

Figure 3:
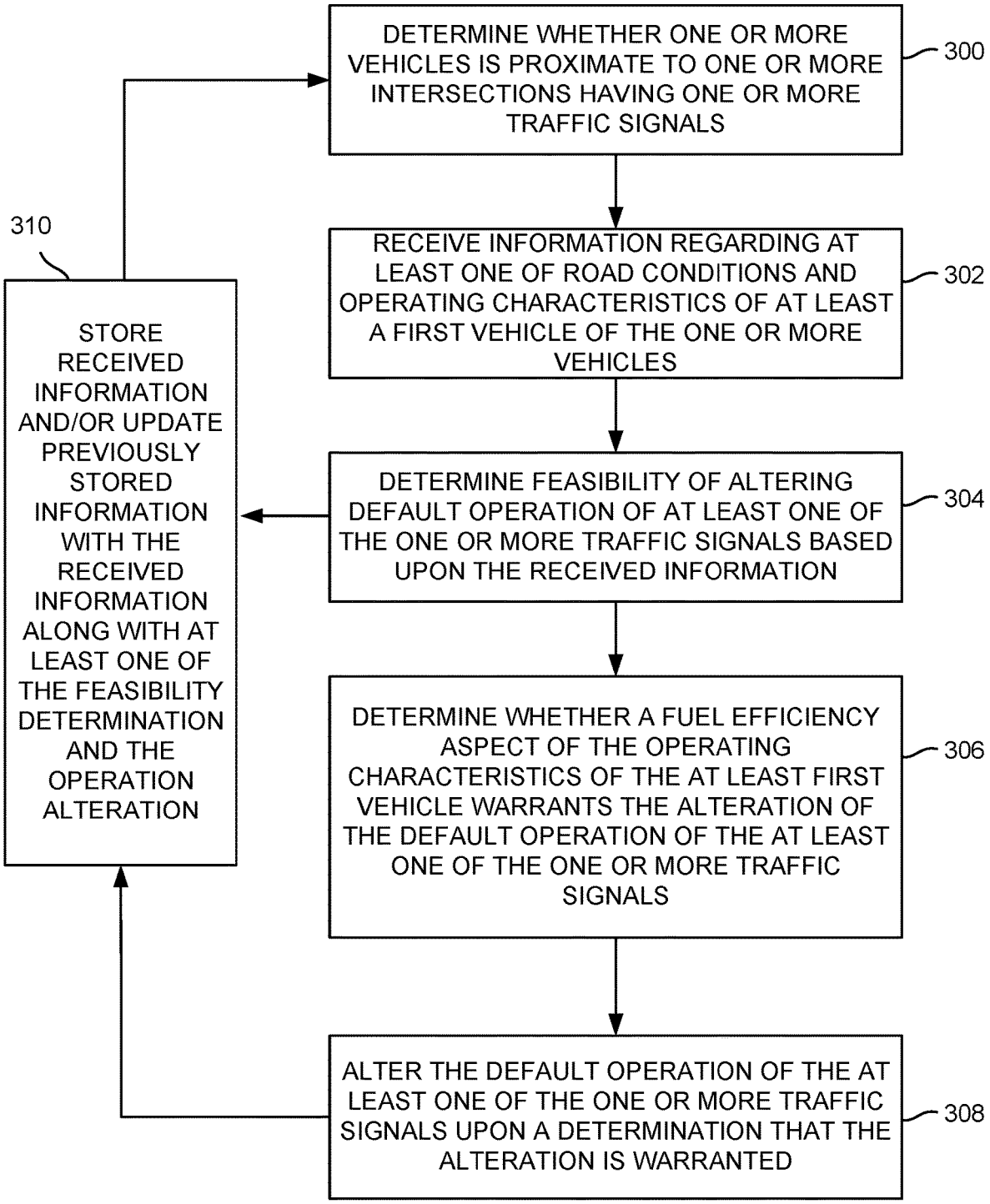
FIG. 3 is a flow chart illustrating example operations that can be performed to dynamically control traffic signals and learn traffic patterns in accordance with various embodiments.

FIG. 3 is a flow chart illustrating example operations that can be performed to effectuate dynamic traffic signal control and traffic learning in accordance with various embodiments. At operation 300, a determination can be made to ascertain whether one or more vehicles are proximate to one or more intersections having one or more traffic signals. As described above, proximity can be determined by roadway infrastructure, such as one or more embedded roadway sensors, sensors implemented in or co-located with traffic signals and/or V2I roadside units. Sensors may also include, but are not limited to, e.g., still and/or video cameras, radar or lidar units, etc. Proximity may also be determined by a vehicle's own sensors and/or information systems. For example, many modern vehicles have navigation systems in which a route to-be-traveled may be input, as well as on board units that receive V2I data. Moreover, many modern vehicles may receive traffic-related information from information providers over radio frequency channels that can be used alone or in conjunction with a navigation system. Accordingly, a vehicle may itself determine how far away it is from a particular intersection (which can be identified by road features such as road signs, traffic signals themselves, etc.). Additionally, cellular phones or similar mobile devices may be used as a navigation system in a vehicle. Such mobile devices can also be configured to communicate with roadway infrastructure in order to receive information and relay, in this case, proximity information.

At operation 302, information about operating characteristics of at least a first vehicle proximate to such intersections, as well as road conditions can be obtained. In some embodiments, vehicle-to-infrastructure (V2I) communications can be leveraged to obtain such information. Moreover, in some embodiments, vehicle-to-vehicle (V2V) communications can be used to exchange information regarding vehicle operating characteristics. Road conditions may encompass a variety of types of information, and may reflect current or historical characteristics of a particular road or section of road that can impact fuel economy. For example, road conditions may include current or historical traffic conditions, evidence of a local event, e.g., a football game, that can impact traffic, current weather conditions, whether a curve or up/downgrade precedes or follows an intersection. Vehicle operating characteristics may be vehicle characteristics that can impact fuel economy. For example, vehicle operating characteristics may include, but are not limited to, a vehicle's current, recent, and/or historical speed, acceleration, and/or fuel efficiency. Vehicle operating characteristics can also refer to a vehicle's distance from an intersection or traffic signal and/or an estimated time of arrival at an intersection or traffic signal.

At operation 304, the feasibility of altering a default operation of the one or more traffic signals can be determined. The feasibility determination may include determining whether or not changing a light of a traffic signal would impact the safety of an approaching vehicle. For example, and referring back to FIG. 1, the operation of traffic signal 110 may be altered to provide priority to vehicle 106 due to vehicle 106 being a fuel efficient vehicle. That is, traffic signal 110, which may currently be red, would be changed to green. However, that would necessitate turning traffic signal 110 red for the part of the roadway on which vehicle 104 is traveling. If vehicle 104 is determined to be traveling too fast in order to allow it to safely stop by the time it reaches intersection A, default operation of traffic signal 110 is maintained.

At operation 306, if it would be feasible to alter operation of the one or more traffic signals, the fuel efficiency of at least the first vehicle can be determined, and a determination can be made regarding whether the fuel efficiency warrants altering traffic signal operation. For example, if fuel economy optimization is a goal, a comparison can be made between the respective fuel economy ratings of those vehicles proximate to an intersection. Referring back to FIG. 1, the fuel efficiency of vehicle 102 (an ICE pickup truck) is less than that of vehicle 104 (an ICE sedan). Accordingly, operation of traffic signal 112 may be altered such that traffic signal 112 stays green, while traffic signal 110 stays red. In this way, the less fuel efficient vehicle (vehicle 102) does not have to stop, which might negatively impact its fuel economy, thereby enabling more fuel efficient operation. As will be described below, other determinations and/or calculations can be performed to determine whether or not altering operation of a traffic signal is warranted.

At operation 308, the default operation of a traffic signal is altered upon a determination that the alteration is warranted. Referring to the above example, operation of traffic signal 110 is altered such that it remains green, and operation of traffic signal 112 is altered such that it remains red. The default operation of traffic signal 110 may have been to change to a red light, and the default operation of traffic signal 112 may have been to change to a green light.

At operation 310, information received (e.g., road conditions and/or vehicle operating characteristics information) may be stored and/or used to update previously stored information. Additionally, at least one of the feasibility determination and the operation alteration may be stored with the received information. In this way, the conditions (road and/or vehicle operation conditions) and information indicative of whether or not an alteration was warranted and the alteration, if warranted, can be correlated and used to train a traffic signal controller (e.g., traffic signal controller 208 of FIG. 2). This information and feasibility/alteration information may be stored in timing database 208A of traffic signal controller 208.

As alluded to previously, altering the operation of traffic signals can be done to promote fuel economy optimization. That is, in accordance with one embodiment, one or more traffic signals at a given intersection or series of intersections can be manipulated based on the attributes of the approaching and stopped vehicles. Such manipulation can be generally described as any altering of traffic signal operation to optimize fuel economy of one or more vehicles. The above-described scenario is an example of such an optimization involving altering light timing (within some safety margin) to allow a vehicle(s) with the lowest fuel economy to move with minimal interruptions or stoppages.

In accordance with some embodiments, a group of vehicles may be judged regarding their collective fuel economy, and altering the operation of one or more traffic signals can be performed to accommodate one or more of the group of vehicles rather than only one vehicle. In accordance with one embodiment, the group of vehicles proximate to an intersection may transmit their respective fuel economy ratings/values to the roadway infrastructure. In accordance with one embodiment, one or more of the group of vehicles may, upon approaching the intersection may share their respective fuel economy ratings/values so that vehicles with similar fuel economy ratings/values can approach as a group, and be considered collectively. V2V communications may be used to effectuate this sharing of vehicle operating characteristics, or near-field, cellular, Wi-Fi, or other communications between mobile devices may be used.

As noted above in describing FIG. 2, one or more of vehicles 202 and 204 may not have V2I/V2V or other communication capabilities. In such a scenario, the aforementioned roadway infrastructure, including one or more of radar/lidar units, cameras, and the like may determine relevant operating characteristics of a non-communicative vehicle to be used as a basis for potentially altering the operation of a traffic signal. For example, a camera may capture a license plate of the non-communicative vehicle, and the make/model may be obtained by transmitting the license plate information to a municipal datastore or other data resource. The make/model may be used to make an assumption about the non-communicative vehicle's fuel economy based on known information associated with the make/model information. Sensors and/or roadside units may be used to ascertain approaching speed of the non-communicative vehicle for use in making a determination as to whether or not altering operation of a traffic signal is warranted.

Figure 4A:
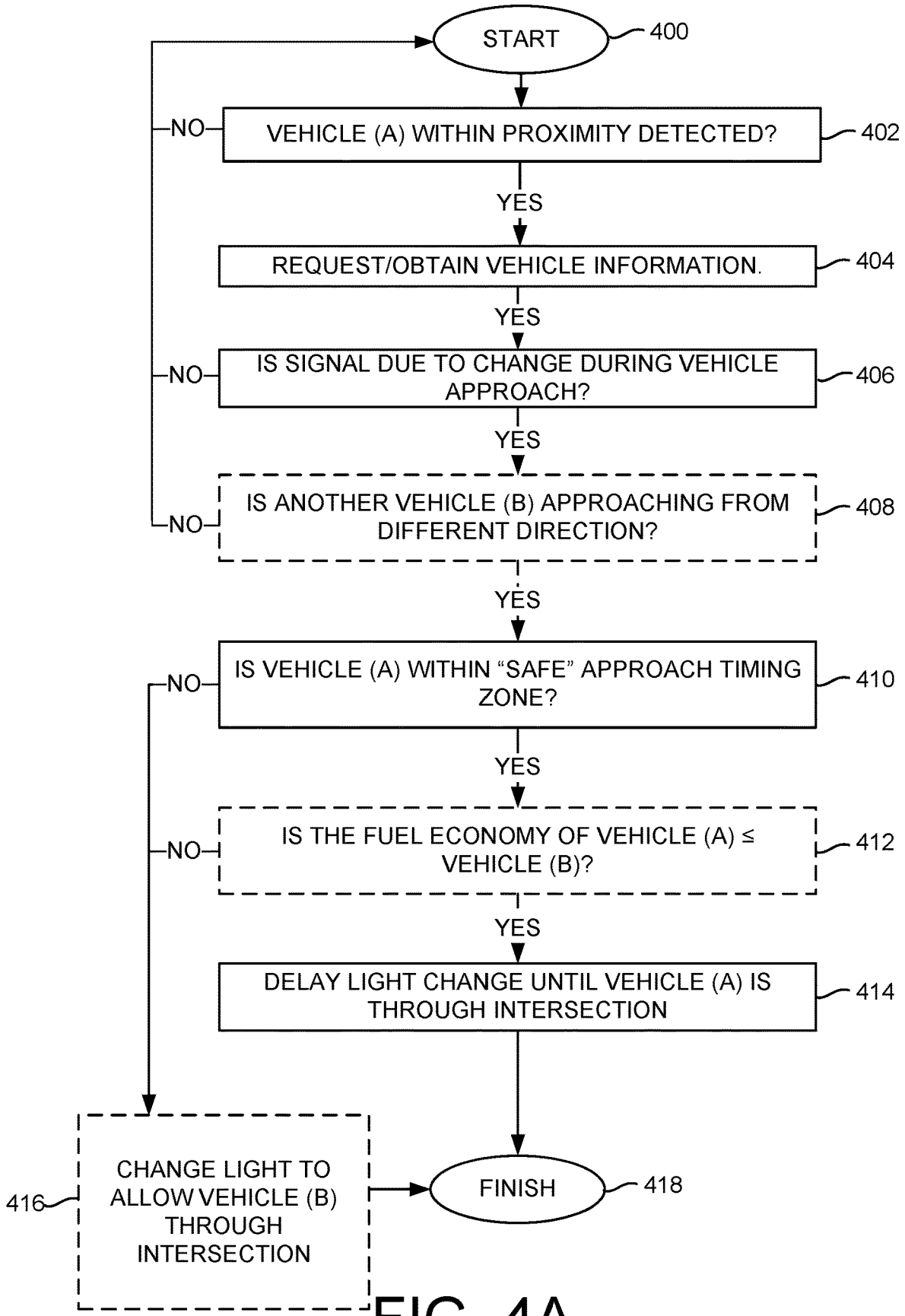
FIG. 4A is a flow chart illustrating example operations that can be performed to optimize fuel economy in accordance with various embodiments.

FIG. 4A illustrates example operations that may be performed to achieve fuel economy optimization in accordance with one embodiment. The start of the method may begin at operation 400, where in some embodiments, V2I communications are enabled, and/or one or more vehicles begin approaching or are stopped an intersection. At operation 402, a determination is made to see whether one or more vehicles are within a certain proximity to an intersection. As noted previously, this determination can be made for one vehicle or a group of vehicles. The particular proximity threshold can vary based on historical speeds of vehicles traveling that particular portion of roadway. For example, portions of the roadway with lower speed limits may implement a proximity threshold that is closer to the intersection versus portions of the roadway with higher speed limits. That is, a traffic signal controller or one or more traffic signals at the intersection may need more time to make the requisite determinations when vehicles are approaching at a faster rate.

At operation 404, the roadway infrastructure, e.g., roadside units, traffic signals, etc., may request or obtain vehicle operating characteristics of those vehicles that are sufficiently proximate to the intersection. As noted above, V2I communications may be one way in which the roadway infrastructure obtains the relevant vehicle(s) operating characteristics, such as speed, distance from the intersection, current or recent fuel economy, etc.

At operation 406, a determination is made regarding whether or not a traffic signal is due to change while one vehicle is approaching. This can be based on the above-obtained vehicle operating characteristics. If so, another determination can be made regarding whether or not at least one other vehicle is approaching the same intersection from a different direction at operation 408. It should be noted that if any of the determinations are negative, e.g., one or more vehicles is not proximate to an intersection, a signal is not due to change, etc., default operation of a traffic signal need not be altered.

If at least one other vehicle is approaching, the above-described feasibility determination can be made. That is, at operation 410, a determination can be made regarding whether or not the other approaching vehicle is within a "safe" approach timing zone. In other words, if the other vehicle is approaching too quickly or is within a certain distance to the intersection such that changing a light would be too sudden for the driver of the vehicle to safely stop or other operate the vehicle (i.e., outside the safe zone), the default operation of the traffic signal at the intersection is maintained. In some embodiments, this can mean that at operation 416, the light is allowed to change (rather than delaying the change), allowing the other vehicle to pass through the intersection. It should be understood that depending on the fuel economy of a stopped vehicle, and the logic determination(s) made, light operation can change. For example, if the other vehicle is supposed to proceed through the intersection due to fuel economy considerations and the first vehicle is approaching and in range of the intersection, two actions may occur. If the first vehicle is traveling slowly enough to safely stop if the light is changed, the light can be changed. If not, the first vehicle is allowed to pass first, and then the light is changed based on the other vehicle's operating conditions.

If the other approaching vehicle is within a safe approach timing zone, the method may progress to comparing the respective fuel economies of the at least two vehicles at operation 412. As described above, in some embodiments, this may comprise a simple comparison to determine which vehicle or group of vehicles has the least/lower fuel efficiency. Other calculations may be made including, but not limited to current approach speed, estimated/calculated wait time, idling fuel economy and cruising fuel economy, etc. Any one or more of these calculations may be used in considering whether or not the fuel economy of one vehicle or group of vehicles is less than that of another.

In still other embodiments, the aforementioned navigation systems found in many modern vehicles can be leveraged by using knowledge of a trip/route input into a navigation system to determine an overall fuel economy of an entire trip. For example, if a vehicle is determined to be traveling on a relatively long road trip, its operation vis-à-vis fuel economy can be improved by altering traffic signal operation to allow it to progress with the least amount of stops possible. This may be contrasted with a vehicle that is traveling a relatively shorter route in an area with many stop signs that would necessitate multiple stops. In this way, fuel economy of a vehicle or group of vehicles may be optimized. It should be noted that in some embodiments, such considerations may be used as one or more weighting factors that can be applied to the fuel economy comparison.

This allows "global" fuel economy to be improved. That is, the cumulative effect of altering, e.g., a plurality of traffic signals, to accommodate low fuel efficient vehicles is an overall improvement in fuel economy. Moreover, even greater effects of fuel economy improvements may be achieved in embodiments where multiple traffic signals and/or traffic grid systems communicate and coordinate operation, e.g., multiple traffic signals up and down one or more roadways.

Accordingly, at operation 414, the changing of lights at the relevant traffic signals may be delayed to allow the other approaching vehicle to proceed through the intersection. After this point, operation of the relevant traffic signals may revert to their default/conventional mode of operation, and the method of dynamically controlling traffic signal operation may end at 418.

It should be noted that operations 408, 412, and 416 may be optional (denoted with hashed lines) in some embodiments. That is, various embodiments may still be used to dynamically control traffic signals when only a single vehicle is present/approaching one or more traffic signals. For example, the fuel economy of vehicle A may be improved or maintained by delaying a light change until it passes an intersection.

In some embodiments, altering the operation of traffic signals can be done to provide traffic priority to vehicles with better fuel economy. For example, altering the operation of traffic signals can be done to give priority to vehicles with better fuel economy. That is, in accordance with one embodiment, one or more traffic signals at a given intersection or series of intersections can be manipulated based on the attributes of the approaching and stopped vehicles. Such manipulation can be generally described as any altering of traffic signal operation to prioritize vehicle travel based on fuel economy. For example, light timing (within some safety margin) can be altered to allow a vehicle(s) with the best/highest fuel economy to move with minimal interruptions or stoppages, thereby maintaining fuel efficiency. Other vehicles operating at lower levels of fuel efficiency may be subsequently prioritized in order of decreasing fuel economy. This may have the effect of encouraging drivers of less fuel efficient vehicles to operate them in a more fuel efficient manner, and/or begin driving more fuel efficient vehicles.

Figure 4B:
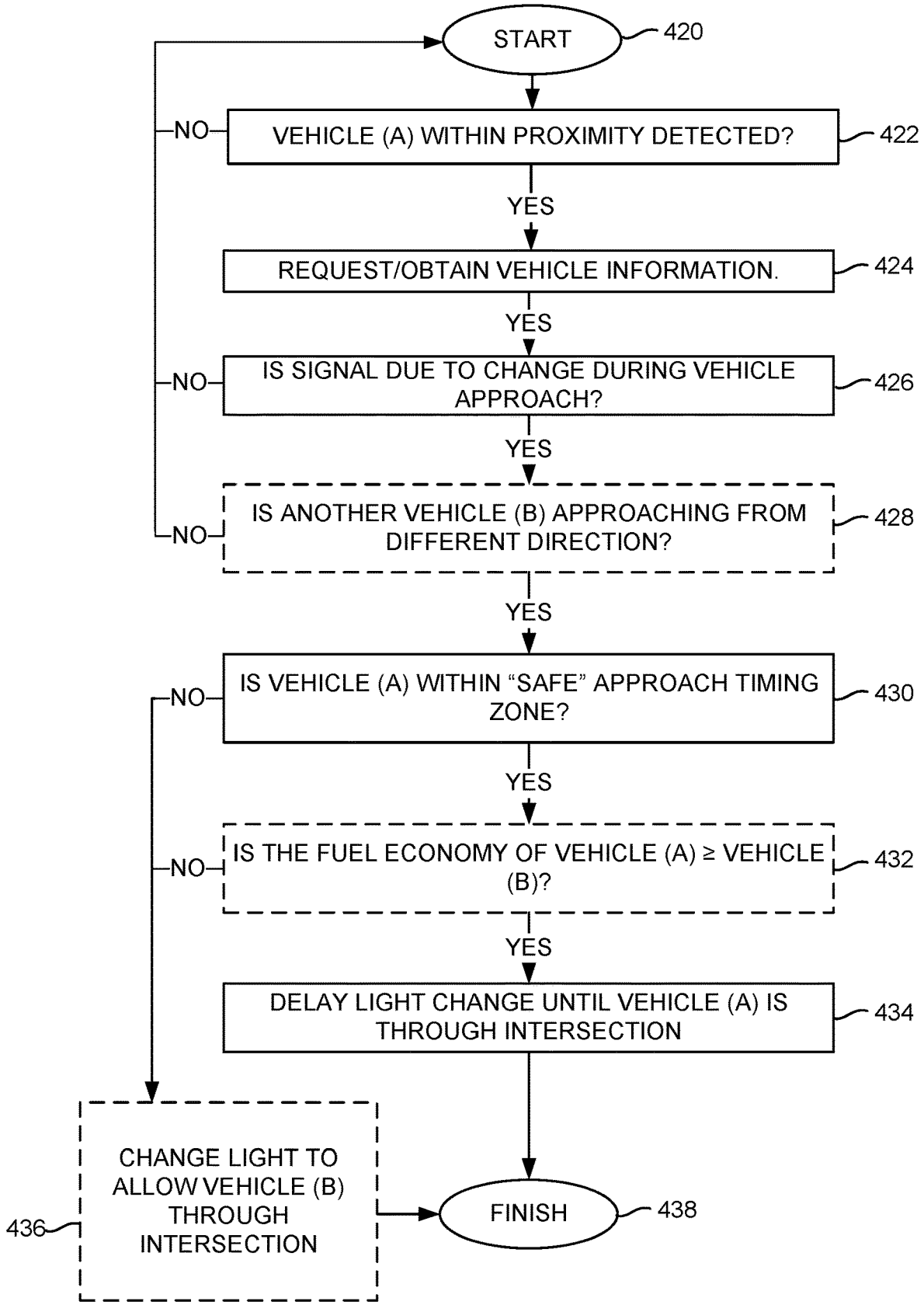
FIG. 4B is a flow chart illustrating example operations that can be performed to prioritize traffic based on fuel economy in accordance with various embodiments.

FIG. 4B illustrates example operations that may be performed to achieve prioritized traffic flow based on fuel economy in accordance with one embodiment. The start of the method may begin at operation 420, where in some embodiments, V2I communications are enabled, and/or one or more vehicles begin approaching or are stopped an intersection. At operation 422, a determination is made to see whether one or more vehicles are within a certain proximity to an intersection. As noted previously, this determination can be made for one vehicle or a group of vehicles. The particular proximity threshold can vary as previously described.

At operation 424, the roadway infrastructure, e.g., roadside units, traffic signals, etc. may request or obtain vehicle operating characteristics of those vehicles that are sufficiently proximate to the intersection. As noted above, V2I communications may be one way in which the roadway infrastructure obtains the relevant vehicle(s) operating characteristics, such as speed, distance from the intersection, current or recent fuel economy, etc.

At operation 426, a determination is made regarding whether or not a traffic signal is due to change while a first of the proximate vehicles is approaching. This can be based on the obtained vehicle operating characteristics. If so, another determination can be made regarding whether or not at least one other (second) vehicle is approaching the same intersection from a different direction at operation 428.

If at least one other vehicle is approaching, the above-described feasibility determination can be made. That is, at operation 430, a determination can be made regarding whether or not the first vehicle is within a "safe" approach timing zone. If the first vehicle is approaching too quickly or is within a certain distance to the intersection such that changing a light would be too sudden for the driver of the vehicle to safely stop or otherwise operate the vehicle (out of the safe zone), the default operation of the traffic signal at the intersection is maintained. In some embodiments, this can mean that at operation 436, the light is allowed to change (rather than delaying the change), allowing the other vehicle to pass through the intersection. It should be understood that depending on the fuel economy of a stopped vehicle, and the logic determination(s) made, light operation can change. For example, if the other vehicle is supposed to proceed through the intersection due to fuel economy considerations and the first vehicle is approaching and in range of the intersection, two actions may occur. If the first vehicle is traveling slowly enough to safely stop if the light is changed, the light can be changed. If not, the first vehicle is allowed to pass first, and then the light is changed based on the other vehicle's operating conditions.

If the first vehicle is within a safe approach timing zone, the method may progress to comparing the respective fuel economies of the at least two vehicles at operation 432. In some embodiments, this may comprise a simple comparison to determine which vehicle or group of vehicles has the highest/best fuel efficiency. Other calculations may be made including, but not limited to current approach speed, estimated/calculated wait time, idling fuel economy and cruising fuel economy, etc. Any one or more of these calculations may be used in considering whether or not the fuel economy of one vehicle or group of vehicles is greater than that of another. In still other embodiments, the aforementioned navigation systems found in many modern vehicles can be leveraged by using knowledge of a trip/route input into a navigation system to determine an overall fuel economy of an entire trip. In some embodiments, this may be used to weight the relative fuel efficiencies of vehicles. For example, although a current/recent fuel economy rating of a vehicle may be less than that of another, the overall trip of the vehicles may be used to skew the comparison of their respective fuel economy ratings.

Accordingly, at operation 434, the changing of lights at the relevant traffic signals may be delayed to allow the first vehicle to proceed through the intersection. After this point, operation of the relevant traffic signals may revert to their default/conventional mode of operation, and the method of dynamically controlling traffic signal operation may end at 438.

It should be noted that operations 428, 432, and/or 436 may be optional (denoted with hashed lines) in some embodiments. That is, various embodiments may still be used to dynamically control traffic signals when only a single vehicle is present/approaching one or more traffic signals. Optimization of fuel economy can be achieved even in a single vehicle scenario, where "priority" can in a sense be provided by allowing passage through one or more intersections with the least amount of stops as possible.

Further still, favoritism can be shown to vehicles having a certain fuel economy, or that have paid money to support roadway infrastructure improvements, for example, as well as to reward drivers that operate their vehicles efficiently. For example, a "pay-to-pass" scheme may be implemented whereby drivers may pay to experience favoritism when traveling through intersections. That is, a vehicle, e.g., vehicle 102 of FIG. 1 may be associated with a driver that has contributed to or paid into a pay-to-pass system. Thus, despite vehicle 102 having low fuel economy, the operation of traffic signals at intersections it approaches can be altered so that it is allowed passage with less stopping. Similarly, the driver of vehicle 106 may operate vehicle 106 in an efficient manner, e.g., minimizing unnecessary acceleration, driving at consistent speeds, etc., so that its ICE is engaged as little as possible. In this way, vehicle 106 can be allowed passage through intersections with less stopping vis-à-vis dynamic signal control as described herein. It should be understood that vehicles may have one or more memory units for storing logs or records regarding operating characteristics and/or events. In this way, the driver's driving habits may be recorded and analyzed to determine whether or not they are operating their vehicle efficiently. Vehicles whose drivers contribute money and/or operate their vehicle(s) in a fuel efficient manner can be rewarded, encouraging other drivers to contribute/contribute more and/or drive in a more fuel efficient manner. Fuel efficient operation can be reflected as an eco-driving score (previously described).

Figure 4C:
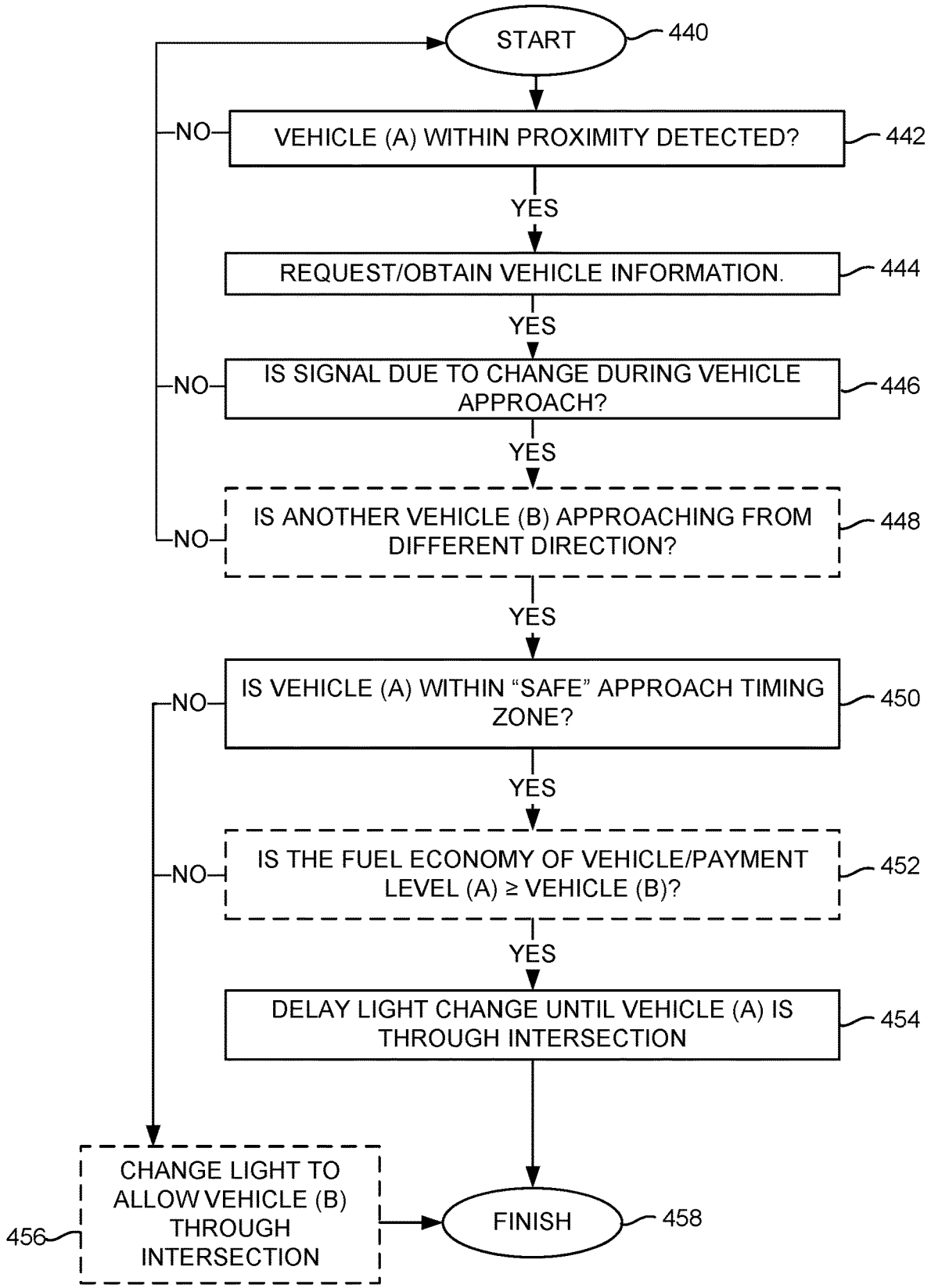
FIG. 4C is a flow chart illustrating example operations that can be performed to exhibit traffic favoritism based on at least one of fuel efficient vehicle operation and monetary contribution in accordance with various embodiments.

FIG. 4C illustrates example operations that may be performed to show favoritism to vehicles based on fuel efficient vehicle operation and/or monetary contribution in accordance with one embodiment. The start of the method may begin at operation 440, where in some embodiments, V2I communications are enabled, and/or one or more vehicles begin approaching or are stopped an intersection. At operation 442, a determination is made to see whether one or more vehicles are within a certain proximity to an intersection. As noted previously, this determination can be made for one vehicle or a group of vehicles. The particular proximity threshold can vary as previously described.

At operation 444, the roadway infrastructure, e.g., roadside units, traffic signals, etc. may request or obtain vehicle operating characteristics of those vehicles that are sufficiently proximate to the intersection. As noted above, V2I communications may be one way in which the roadway infrastructure obtains the relevant vehicle(s) operating characteristics, such as speed, distance from the intersection, current or recent fuel economy, eco-driving score, etc.

At operation 446, a determination is made regarding whether or not a traffic signal is due to change while a first of the proximate vehicles is approaching. This can be based on the previously obtained vehicle operating characteristics. If so, another determination can be made regarding whether or not at least one other (second) vehicle is approaching the same intersection from a different direction at operation 448. It should be noted that if any of the determinations made at operations 442, 446, and/or 448 are in the negative, alteration of the default traffic signal operation may not be needed.

If at least one other vehicle is approaching, the above-described feasibility determination can be made. That is, at operation 450, a determination can be made regarding whether or not the first vehicle is within a "safe" approach timing zone. If the first vehicle is approaching too quickly or is within a certain distance to the intersection such that changing a light would be too sudden for the driver of the vehicle to safely stop or otherwise operate the vehicle (out of the safe zone), the default operation of the traffic signal at the intersection is maintained. In some embodiments, this can mean that at operation 456, the light is allowed to change (rather than delaying the change), allowing the other vehicle to pass through the intersection. It should be understood that depending on the fuel economy of a stopped vehicle, and the logic determination(s) made, light operation can change. For example, if the other vehicle is supposed to proceed through the intersection due to fuel economy considerations and the first vehicle is approaching and in range of the intersection, two actions may occur. If the first vehicle is traveling slowly enough to safely stop if the light is changed, the light can be changed. If not, the first vehicle is allowed to pass first, and then the light is changed based on the other vehicle's operating conditions.

If the first vehicle is within a safe approach timing zone, the method may progress to comparing the respective fuel economies of the at least two vehicles at operation 452. As described above, fuel economy in this embodiment can be measured as a function of the manner in which a vehicle is operated. In some embodiments, this may comprise a simple comparison to determine which vehicle or group of vehicles has the highest/best fuel efficiency. Other calculations may be made including, but not limited to current approach speed, estimated/calculated wait time, idling fuel economy and cruising fuel economy, etc. Any one or more of these calculations may be used in considering whether or not the fuel economy of one vehicle or group of vehicles is better than that of another. In still other embodiments, the aforementioned navigation systems found in many modern vehicles can be leveraged by using knowledge of a trip/route input into a navigation system to determine an overall fuel economy of an entire trip. In some embodiments, this may be used to weight the relative fuel efficiencies of vehicles. Moreover, at operation 452, a determination can be made to ascertain whether or not the first vehicle/first group of vehicles and/or the second vehicle/second group of vehicles has paid into a pay-to-pass or similar system, and if so, what their respective contributions/payments are. It should be noted that in some embodiments, an on board unit of a car, a driver's mobile device, or some other transponder apparatus may be configured to signify his/her status as a pay-to-pass contributor. In this way, the roadway infrastructure, e.g., cameras, roadside units, traffic signals, etc. may recognize the vehicle as being associated with a paying driver.

Accordingly, at operation 454, the changing of lights at the relevant traffic signals may be delayed to allow the first vehicle (provided is has better fuel economy and/or has contributed the most money) to proceed through the intersection. After this point, operation of the relevant traffic signals may revert to their default/conventional mode of operation, and the method of dynamically controlling traffic signal operation may end at 438. It should be noted that priority can be given based on better fuel economy or higher payment depending on the needs/desires of the entity, e.g., municipality, controlling the operation of the traffic signals. This can be used as a weighting factor. For example, more weight can be given to pay-to-pass status versus fuel efficient operation if a municipality is seeking to fund certain infrastructure improvements. Once the improvements have been completed, the municipality may shift its weighting to favor fuel efficient operation. In some embodiments either fuel efficient operation or monetary contribution can be set as an initial distinguishing factor for favoritism. In the event that multiple vehicles have the same/similar fuel efficient operating characteristics and/or have paid the same/similar amount to a pay-to-pass system, the other of fuel efficient operation or monetary contribution may be used as the distinguishing factor.

It should be noted that operations 448, 452, and 456 may be optional (denoted with hashed lines) in some embodiments. That is, various embodiments may still be used to dynamically control traffic signals when only a single vehicle is present/approaching one or more traffic signals to achieve. That is, even a single vehicle can be shown favoritism may altering traffic signal operation to accommodate the travel of the single vehicle, e.g., through minimized or an elimination of traffic stops.

In some embodiments, the system(s) controlling operation of traffic signals can be configured to collect information so that the system(s) can learn traffic patterns, vehicle operating characteristics, etc. in order to effectuate the above-mentioned features. For example, traffic signals or sets of traffic signals (determined by proximity, or effect on each other) may be configured to collect relevant road conditions and/or vehicle operating characteristics so that it/they can learn traffic patterns of approaching vehicles. Overtime, the traffic signal(s) can learn approaching vehicle characteristics including, for example, vehicle speed, vehicle acceleration, distance from intersection, frequency of turning, etc. It should be noted that weather, local events that can impact traffic, and the like may also be considered. For example, in areas such as Washington, D.C., certain times of the year experience heavy tourist traffic or changing lane/road conditions to accommodate political activities. Such events can be learned and used to adjust traffic signal operation. This can in turn, be used to improve fuel efficiency by optimizing the timing of the traffic signals for given times, days of the week, or even weeks of the year. For example, traffic signals may be coordinated such that heavily travelled routes are prioritized for steady traffic flows based on actual road conditions and/or vehicle operating characteristics. One or more databases, e.g., timing database 208A of FIG. 2 may be used to store/update stored information. Traffic signal controller 208 may, based on the stored and/or updated information maintained in timing database 208A, revise traffic signal light illumination timing/cycling. It should be understood that the revised traffic signal light illumination timing/cycling may then become or can be used as a basis for deriving what has been previously referred to as the default operation, timing, signaling of a traffic signal. Further stored/updated data may further revise the default timing. In this way, less real-time determinations regarding, e.g., fuel economy priority or vehicle preferential treatment, need to be performed resulting in less resource consumption, information transfer, and the like. Moreover, over time, it is possible that maintaining default operation of traffic signals (e.g., when vehicles are outside the safe zone) can be avoided more often due to the ability to learn/predict traffic patterns. Accordingly, optimized operation of traffic signals can become a more prevalent occurrence. For example, Friday traffic (generally heavy with vehicles traveling to weekend vacation locales) can be accommodated by providing improved traffic flow based on learned traffic patterns and resulting traffic signal alterations. Additionally, information regarding particular vehicles can be learned, e.g., certain vehicles that consistently traverse a particular intersection at a certain time on a certain day. In this way, traffic signals that would be altered or adjusted can be used as a default during the identified day(s)/time(s) of travel of that particular vehicle. Periodic or aperiodic checks may be performed to ensure that the learned and applied traffic signal scheme/cycling is appropriate.

Figure 5:
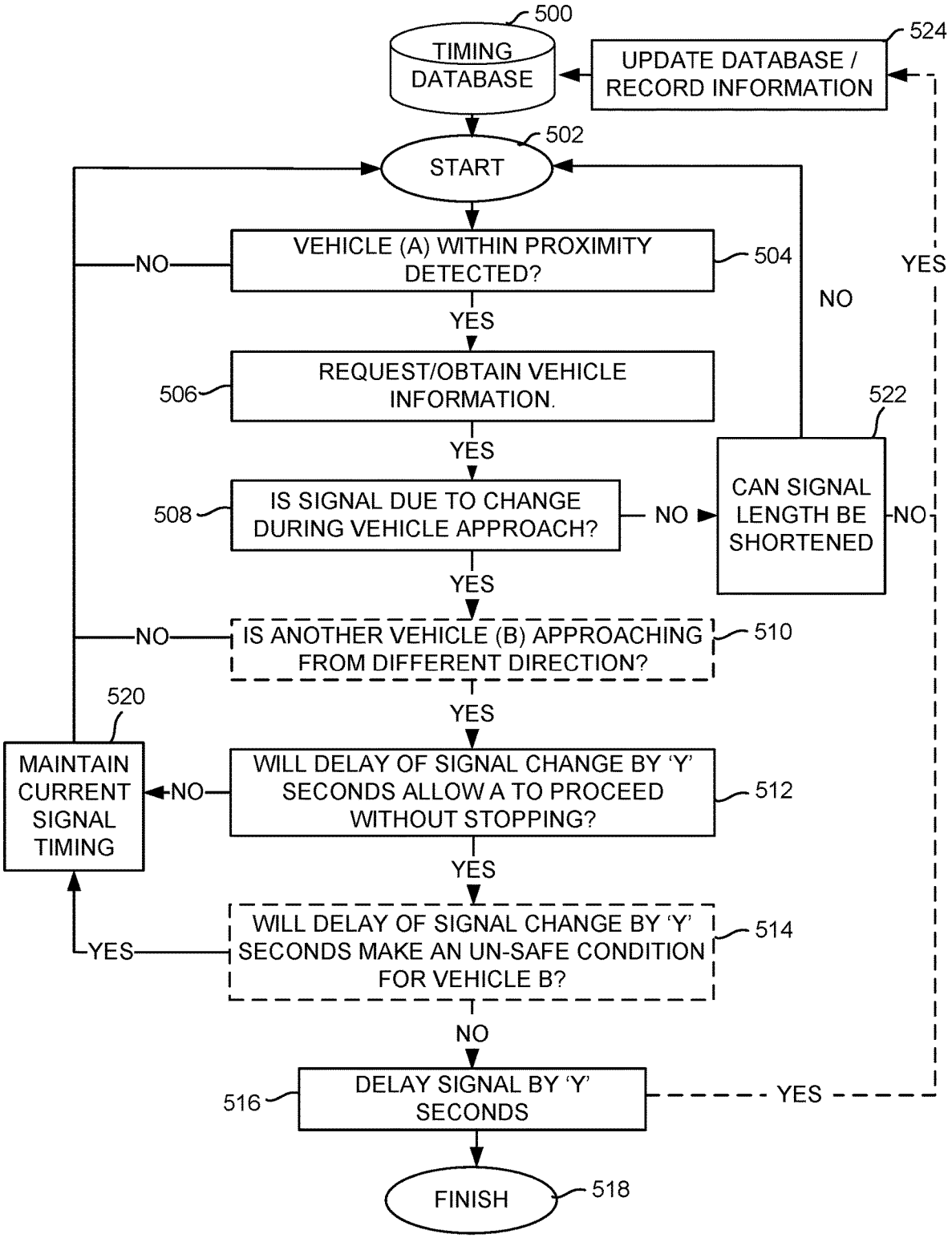
FIG. 5 is a flow chart illustrating example operations that can be performed to learn traffic patterns in accordance various embodiments

FIG. 5 illustrates example operations that may be performed to effectuate traffic pattern learning n in accordance with one embodiment. As alluded to above, a timing database, e.g., timing database 500 (which may be one embodiment of timing database 208A of FIG. 2), may provide timing control for changing the lights of one or more traffic signals at an intersection. The start of the method may begin at operation 502, where in some embodiments, V2I communications are enabled, and/or one or more vehicles begin approaching or are stopped an intersection. At operation 504, a determination is made to see whether one or more vehicles are within a certain proximity to an intersection. As noted previously, this determination can be made for one vehicle or a group of vehicles. The particular proximity threshold can vary as previously described.

At operation 506, the roadway infrastructure, e.g., roadside units, traffic signals, etc. may request or obtain vehicle operating characteristics of those vehicles that are sufficiently proximate to the intersection. As noted above, V2I communications may be one way in which the roadway infrastructure obtains the relevant vehicle(s) operating characteristics, such as speed, distance from the intersection, current or recent fuel economy, level of contribution to a pay-to-pass system, eco-driving score, etc.

At operation 508, a determination is made regarding whether or not a traffic signal is due to change while a first of the proximate vehicles is approaching. This can be based on the previously obtained vehicle operating characteristics. If not, a determination can be made regarding whether or not a current traffic signal light illumination time can be shortened at operation 522. Information reflecting the conditions and/or amount of time by which the illumination time was shortened may be recorded in timing database 500 and/or used to update currently stored data therein at operation 524

If a traffic signal is due to change, another determination can be made regarding whether or not at least one other (second) vehicle is approaching the same intersection from a different direction at operation 510. It should be noted that if any of the determinations made at operations 504, 508, 510 and/or 522 are in the negative, alteration of the default traffic signal operation may not be needed.

If at least one other vehicle is approaching, a determination can be made at operation 512 to determine whether delaying the signal change by some amount, e.g., "Y" seconds, will allow the first vehicle to proceed through the intersection without stopping. If not, current traffic signal timing may be maintained at operation 520, and no alterations to the operation of the traffic signal are performed. If the delay will allow the first vehicle to pass through the intersection without stopping, another determination may be made at operation 514 to determine whether the delay will result in an un-safe driving condition for the second, approaching vehicle. If so, operation of the method reverts to operation 520, where current traffic signal timing is maintained. If not, and the second, approaching vehicle is not put into danger/an unsafe driving condition, the traffic signal light illumination time is delayed at operation 516. Here as well, the relevant road conditions/vehicle operating characteristics and/or delay time may be recorded in timing database 500 at operation 524. The method may then end at 518.

It should be noted that operations 510 and 514 may be optional (denoted with hashed lines) in some embodiments. That is, various embodiments may still be used to learn traffic patterns, individual vehicle travel patterns, etc. when only a single vehicle is present/approaching one or more traffic signals.

Traffic pattern learning in accordance with various embodiments may reduce reaction time. That is, traffic signals can be configured to operate in a more pro-active manner, rather than solely in response to currently-obtained or currently-received road conditions and vehicle operating characteristics information. In some embodiments, learned traffic patterns can be used to pre-set or pre-alter one or more traffic signals so that any resulting alteration to the timing/cycling of light changes is not as drastic. In this way, traffic flows and optimization, prioritization, and favoritism can be achieved with less conflict and/or less instances of un-safe driving conditions that prohibit traffic signal adjustments. Moreover, the amount of communications and use of system resources may be reduced. In some embodiments, only some vehicles may be surveyed for their respective operating characteristics, rather than surveying each and every vehicle at or approaching an intersection.

It should be noted that different priorities, optimization goals/schemes may be altered throughout a day to accommodate different traffic/road conditions that are generally experienced.

Although various embodiments described herein are described in the context of improving or promoting fuel efficiency, various embodiments may be adapted to promote safe driving. For example, weather may be considered when altering traffic signal operation such that traffic signal operation can be altered to effectuate slower or more careful driving. If current conditions involve rain, default operation of traffic signals may be altered, e.g., yellow lights may be maintained longer prompting drivers to slow down more. As another example, learned traffic patterns may be used to slow down traffic to avoid collisions/accidents at certain times of the day/night. Moreover, weather again may be used as a safety consideration, wherein traffic signals may be altered to present more red lights in inclement weather to effectuate an overall slowdown in traffic. In other scenarios, more green lights may be presented to keep traffic moving to avoid sudden braking that could lead to accidents. These alterations can be effectuated irrespective of fuel economy.

Figure 6:
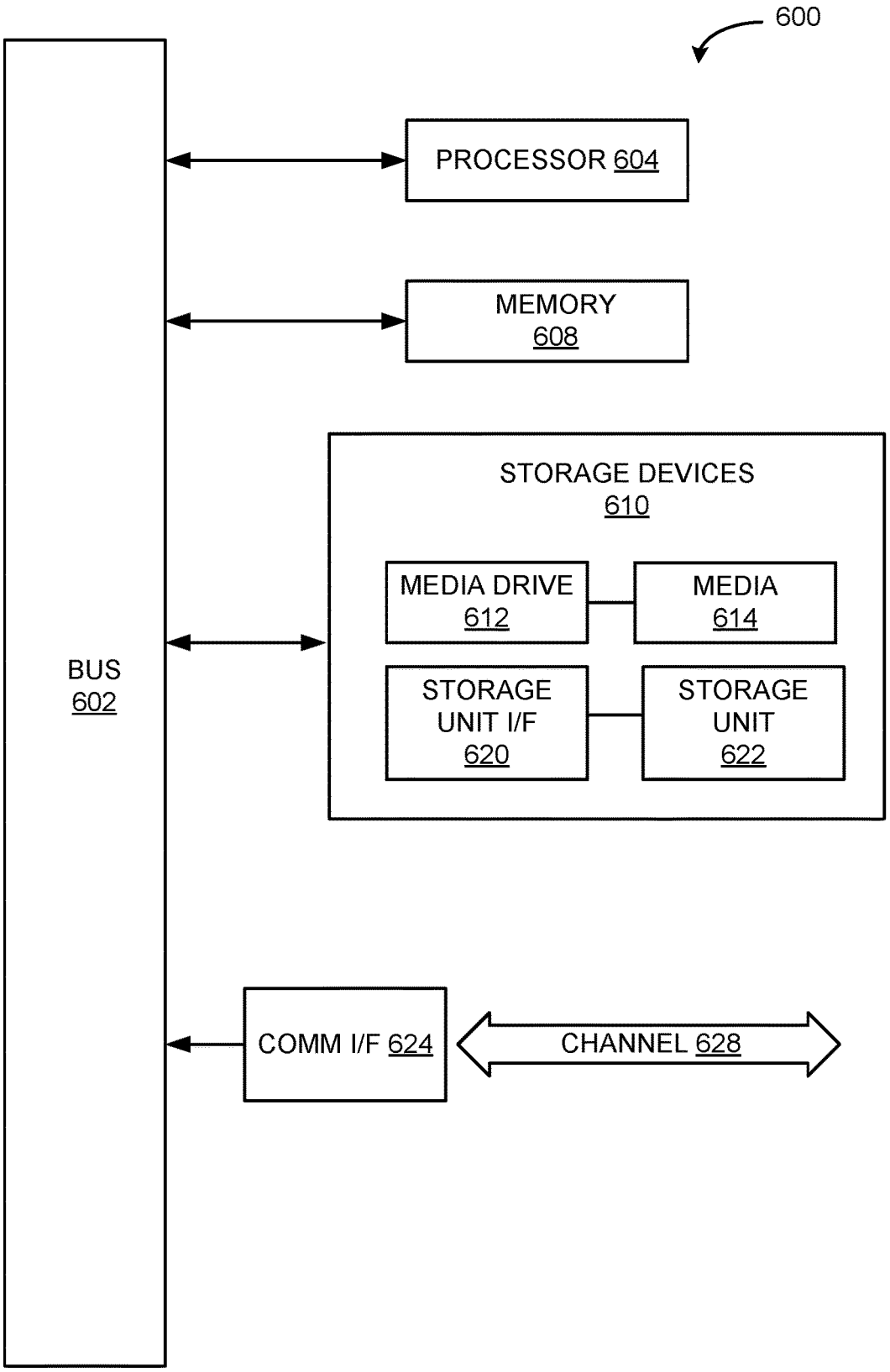
FIG. 6 is an example computing component that may be used to implement various features of embodiments described in the present disclosure.

As used herein, the term component might describe a given unit of functionality that can be performed in accordance with one or more embodiments of the present application. As used herein, a component might be implemented utilizing any form of hardware, software, or a combination thereof. For example, one or more processors, controllers, ASICs, PLAs, PALs, CPLDs, FPGAs, logical components, software routines or other mechanisms might be implemented to make up a component. Various components described herein may be implemented as discrete components or described functions and features can be shared in part or in total among one or more components. In other words, as would be apparent to one of ordinary skill in the art after reading this description, the various features and functionality described herein may be implemented in any given application. They can be implemented in one or more separate or shared components in various combinations and permutations. Although various features or functional elements may be individually described or claimed as separate components, it should be understood that these features/functionality can be shared among one or more common software and hardware elements. Such a description shall not require or imply that separate hardware or software components are used to implement such features or functionality.

Where components are implemented in whole or in part using software, these software elements can be implemented to operate with a computing or processing component capable of carrying out the functionality described with respect thereto. One such example computing component is shown in FIG. 6. Various embodiments are described in terms of this example-computing component 600. After reading this description, it will become apparent to a person skilled in the relevant art how to implement the application using other computing components or architectures.

Referring now to FIG. 6, computing component 600 may represent, for example, computing or processing capabilities found within a self-adjusting display, desktop, laptop, notebook, and tablet computers. They may be found in hand-held computing devices (tablets, PDA's, smart phones, cell phones, palmtops, etc.). They may be found in workstations or other devices with displays, servers, or any other type of special-purpose or general-purpose computing devices as may be desirable or appropriate for a given application or environment. Computing component 600 might also represent computing capabilities embedded within or otherwise available to a given device. For example, a computing component might be found in other electronic devices such as, for example, portable computing devices, and other electronic devices that might include some form of processing capability.

Computing component 600 might include, for example, one or more processors, controllers, control components, or other processing devices. This can include a processor, and/or any one or more of the components making up dynamic traffic control and learning system 200 and its component parts, traffic signal controller 208, ECUs 202A and 204A of vehicles 2020 and 204, respectively, etc. Processor 604 might be implemented using a general-purpose or special-purpose processing engine such as, for example, a microprocessor, controller, or other control logic. Processor 604 may be connected to a bus 602. However, any communication medium can be used to facilitate interaction with other components of computing component 600 or to communicate externally.

Computing component 600 might also include one or more memory components, simply referred to herein as main memory 608. For example, random access memory (RAM) or other dynamic memory, might be used for storing information and instructions to be executed by processor 604. Main memory 608 might also be used for storing temporary variables or other intermediate information during execution of instructions to be executed by processor 604. Computing component 600 might likewise include a read only memory ("ROM") or other static storage device coupled to bus 602 for storing static information and instructions for processor 604.

The computing component 600 might also include one or more various forms of information storage mechanism 610, which might include, for example, a media drive 612 and a storage unit interface 620. The media drive 612 might include a drive or other mechanism to support fixed or removable storage media 614. For example, a hard disk drive, a solid state drive, a magnetic tape drive, an optical drive, a compact disc (CD) or digital video disc (DVD) drive (R or RW), or other removable or fixed media drive might be provided. Storage media 614 might include, for example, a hard disk, an integrated circuit assembly, magnetic tape, cartridge, optical disk, a CD or DVD. Storage media 614 may be any other fixed or removable medium that is read by, written to or accessed by media drive 612. As these examples illustrate, the storage media 614 can include a computer usable storage medium having stored therein computer software or data.

In alternative embodiments, information storage mechanism 610 might include other similar instrumentalities for allowing computer programs or other instructions or data to be loaded into computing component 600. Such instrumentalities might include, for example, a fixed or removable storage unit 622 and an interface 620. Examples of such storage units 622 and interfaces 620 can include a program cartridge and cartridge interface, a removable memory (for example, a flash memory or other removable memory component) and memory slot. Other examples may include a PCMCIA slot and card, and other fixed or removable storage units 622 and interfaces 620 that allow software and data to be transferred from storage unit 622 to computing component 600.

Computing component 600 might also include a communications interface 624. Communications interface 624 might be used to allow software and data to be transferred between computing component 600 and external devices. Examples of communications interface 624 might include a modem or softmodem, a network interface (such as an Ethernet, network interface card, WiMedia, IEEE 802.XX or other interface). Other examples include a communications port (such as for example, a USB port, IR port, RS232 port Bluetooth® interface, or other port), or other communications interface. Software/data transferred via communications interface 624 may be carried on signals, which can be electronic, electromagnetic (which includes optical) or other signals capable of being exchanged by a given communications interface 624. These signals might be provided to communications interface 624 via a channel 628. Channel 628 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to transitory or non-transitory media. Such media may be, e.g., memory 608, storage unit 620, media 614, and channel 628. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing component 600 to perform features or functions of the present application as discussed herein.

It should be understood that the various features, aspects and functionality described in one or more of the individual embodiments are not limited in their applicability to the particular embodiment with which they are described. Instead, they can be applied, alone or in various combinations, to one or more other embodiments, whether or not such embodiments are described and whether or not such features are presented as being a part of a described embodiment. Thus, the breadth and scope of the present application should not be limited by any of the above-described exemplary embodiments.

Terms and phrases used in this document, and variations thereof, unless otherwise expressly stated, should be construed as open ended as opposed to limiting. As examples of the foregoing, the term "including" should be read as meaning "including, without limitation" or the like. The term "example" is used to provide exemplary instances of the item in discussion, not an exhaustive or limiting list thereof. The terms "a" or "an" should be read as meaning "at least one," "one or more" or the like; and adjectives such as "conventional," "traditional," "normal," "standard," "known." Terms of similar meaning should not be construed as limiting the item described to a given time period or to an item available as of a given time. Instead, they should be read to encompass conventional, traditional, normal, or standard technologies that may be available or known now or at any time in the future. Where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "component" does not imply that the aspects or functionality described or claimed as part of the component are all configured in a common package. Indeed, any or all of the various aspects of a component, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A method of traffic signaling executed by a processor, comprising:

determining whether one or more vehicles is proximate to one or more intersections having one or more traffic signals;

receiving information regarding at least one of road conditions and operating characteristics of at least a first vehicle of the one or more vehicles;

determining a feasibility of altering operation of at least one of the one or more traffic signals based upon the received information;

determining whether the at least one of the road conditions and the operating characteristics of the at least first vehicle warrants the alteration of the operation of the at least one of the one or more traffic signals;

altering the operation of the at least one of the one or more traffic signals upon a determination that the alteration is warranted;

learning, over a period of time, traffic priorities near or at the one or more intersections based on the alterations to the operation of the at least one of the one or more traffic signals; and further altering the operation of the at least one of the one or more traffic signals to achieve a desired traffic flow along a section of roadway including the one or more intersections based on the learned traffic priorities.

2. The method of claim 1, wherein determining the feasibility of altering the operation of the at least one of the one or more traffic signals comprises determining whether the at least one of the one or more traffic signals is due for a light change while the at least first vehicle is approaching at least one of the one or more intersections.

3. The method of claim 2, wherein determining the feasibility of altering the operation of the at least one of the one or more traffic signals further comprises determining whether a second vehicle of the one or more vehicles is approaching the at least one of the one or more intersections from a direction different from that of the first vehicle.

4. The method of claim 3, wherein determining the feasibility of altering the operation of the at least one of the one or more traffic signals further comprises determining whether the at least first vehicle is located within a safe approach timing zone relative to the at least one of the one or more intersections.

5. The method of claim 4, further comprising maintaining a default operation mode of the at least one of the one or more traffic signals upon a determination that the at least first vehicle is not located with the safe approach timing zone.

6. The method of claim 4, further comprising at least one of storing the received information and updating previously stored information with the received information along with at least one of the feasibility determination and information representative of the alteration to the operation of the at least one of the one or more traffic signals.

7. The method of claim 6, further comprising revising a default operation mode of the at least one of the one or more traffic signals based on the at least one of the stored, received information and the updated, stored information.

8. The method of claim 1, wherein the desired traffic flow comprises a steady traffic flow through the one or more intersections.

9. The method of claim 1, wherein further altering the operation of the at least one of the one or more traffic signals to achieve the desired traffic flow comprises further altering the operation of the at least one of the one or more traffic signals in accordance with a determined date and duration of altered operation.

10. A system of traffic signaling, comprising:

at least one processor; and at least one memory unit operatively connected to the processor, the at least one memory unit having stored thereon, at least one computer program comprising computer code causing the at least one processor to perform the following:

learn, over a period of time, traffic priorities near or at one or more intersections based on alterations to operation of at least one of one or more traffic signals at the one or more intersections, the learning of the traffic priorities and the altering of the operation of the at least one of the one or more traffic signals being based on received information regarding at least one of road conditions near or at the one or more intersections and operating characteristics of at least a first vehicle proximate to the one or more intersections;

pre-set the operation of the at least one of the one or more traffic signals based on the learned traffic priorities; and alter the pre-set operation of the at least one of the one or more traffic signals based on a current determination of the at least one of the road conditions near or at the one or more intersections and the operating characteristics of the at least first vehicle proximate to the one or more intersections.

11. The system of claim 10, wherein the first vehicle communicates its operating characteristics to one or more roadside units via one or more dedicated short-range communications channels of an intelligent transportation system, wherein the at least one processor and the least one memory receive at least one of the road conditions and the operating characteristics from the one or more roadside units.

12. The system of claim 11, further comprising one or more sensors implemented as part of roadway infrastructure adapted to obtain identifying information from the at least first vehicle, and transmit the identifying information to an information resource to determine a fuel efficiency aspect of the operating characteristics of the at least first vehicle.

13. The system of claim 10, further comprising a timing database operatively connected to at least one traffic signal controller, wherein the at least one traffic signal controller accesses timing data stored in the timing database to determine timing of subsequent light changes of the at least one of the one or more traffic signals.

14. The system of claim 13, wherein the timing data is derived from the at least one of the road conditions and the operating characteristics of the at least first vehicle.

15. The system of claim 14, wherein the computer code further causes the at least one processor to predict additional alterations to the timing of subsequent light changes based upon a pattern of traffic at or proximate to the one or more intersections observed via the at least one of the road conditions and the operating characteristics of the at least first vehicle.

* * * * *